US005540866A

United States Patent [19]

Aszman et al.

[11] Patent Number: 5,540,866

[45] Date of Patent: Jul. 30, 1996

[54] DISHWASHING POWER INCLUDING ALKYL BENZENE SULPHONATES AND MAGNESIUM OR CALCIUM

[75] Inventors: Harry Aszman, Englishtown; Chung Lee, Edison, both of N.J.

[73] Assignee: Colgate-Palmolive Co., Piscataway, N.J.

[21] Appl. No.: 395,550

[22] Filed: Feb. 28, 1995

[51] Int. Cl.[6] ..... C11D 1/18; C11D 3/26

[52] U.S. Cl. ..... 510/220; 510/509; 510/228; 510/235

[58] Field of Search ..... 252/549, 550, 252/173, 174.14, DIG. 1, DIG. 15, DIG. 17, 174

[56] References Cited

U.S. PATENT DOCUMENTS

| | | | |
|---|---|---|---|
| 4,289,640 | 9/1981 | Falivene | 252/95 |
| 4,326,971 | 4/1982 | Wixon | 232/8.75 |
| 4,343,713 | 8/1982 | Wise | 252/92 |
| 4,417,994 | 11/1983 | Stoddart | 252/135 |
| 4,450,085 | 8/1984 | Wixon | 252/8.75 |
| 4,502,986 | 3/1985 | Robson | 252/526 |
| 4,569,773 | 2/1986 | Ramachandran et al. | 252/8.7 |
| 5,026,400 | 6/1991 | Holland et al. | 8/137 |
| 5,236,615 | 8/1993 | Trinh et al. | 252/124.11 |
| 5,415,813 | 5/1995 | Misselyn et al. | 252/547 |

*Primary Examiner*—Paul Lieberman
*Assistant Examiner*—Necholus Ogden
*Attorney, Agent, or Firm*—Richard E. Nanfeldt; James Serafino

[57] ABSTRACT

A spray dried, unbuilt powder dishwashing detergent composition incorporating a source of magnesium or calcium ions; an anionic or non-ionic surfactant system, a filler, an alkali metal bicarbonate to yield a pH in the wash liquor of 6 to 10, and the balance being water.

4 Claims, No Drawings

DISHWASHING POWER INCLUDING ALKYL BENZENE SULPHONATES AND MAGNESIUM OR CALCIUM

FIELD OF THE INVENTION

This invention relates to powder detergent compositions and particularly to substantially unbuilt dishwashing detergent compositions incorporating a source of magnesium or calcium ions.

More particularly this invention relates to a powdered, light duty detergent composition comprising approximately by weight: from about 15 to about 35% of an anionic and/or non-ionic surfactant, preferably from about 20 to about 30% of an anionic surfactant, such as $C_{10}$–$C_{13}$ linear alkylbenzene sulfonate; from about 2 to about 15% of a magnesium or calcium containing compound such as, a magnesium or calcium salt, from about 1 to about 10% of an alkali metal bicarbonate, from about 30 to about 80% of a filler, such as sodium sulfate; with the balance being water; wherein, the quantity of bicarbonate is varied to obtain a pH in the wash solution within the range of about 6 to about 10 (approximately a 1% solution of this powder detergent in the wash water), preferably from about 8 to about 10 and the formulation does not contain any builders.

BACKGROUND OF THE INVENTION

Non-built light-duty liquid detergents compositions suitable for use in washing dishes are well-known. The term "dishes" refers to any utensils involved in food preparation and/or consumption which may be required to be washed to free the dishes from food particles and other food residues, greases, proteins, starches, gums, dyes, oils and burnt organic residues. Many such formulations in commercial use are based on a sulphonate-type anionic surfactants, such as linear alkylbenzene sulphonates for maximum biodegradability. Details on this type of product are taught in U.S. Pat. No. 4,537,709. However, powder based dishwashing products are generally not found. A powdered dishwashing product can have significant advantages in terms of economy of manufacture, shipping and use, as well as, environmental benefits through the elimination of plastic waste by utilizing natural container materials. The instant invention relates to a novel powdered dishwashing product having significant quantity of magnesium or calcium ions wherein these ions attack grease build-up which is a common problem in many dishwashing situations.

The use of magnesium or calcium ions to enhance detergent foam and detergency is taught in the patent literature and disclosed in U.S. Pat. Nos. 2,908,651, and 4,435,317, and British Patent Specifications 1,524,441 and 1,551,074. The art teaches that these formulations have enhanced performance, particularly when used in water of low mineral hardness. U.S. Pat. No. 4,482,268 discloses certain other advantages to using magnesium sulfate in the presence of nonionic-based powdered detergent formulations. Nevertheless the products made in accordance with these teachings have all been found to be non-optimum in various ways with respect to form, raw material expense, phase stability on storage, performance in water of varying hardness, harsh effect on hands and suds profile.

Accordingly, research has continued for compositions having improved economy, performance and in use characteristics and it has now been found that certain combinations of active ingredients can provide a range of enhanced properties not thought previously attainable in one formulation. More particularly it has been found possible to provide stable powdered dishwashing formulations of improved greasy soil removal, suds profile, and economy.

This invention relates to economical powdered form anionic surfactant based compositions, with significant levels of magnesium or calcium salts, formulated without the traditional powdered detergent addition of phosphate or silicate based builders, wherein the composition provides enhanced greasy soil removal and good suds profile. The improved detergency in powdered products with the addition of various phosphates and silicates, and borate builders is taught in U.S. Pat. No. 4,524,012. Phosphates have been shown to inactivate or sequester the polyvalent metal ions which cause water hardness. The effect of water hardness is obvious with soap based detergents in that precipitates are formed; and no lather is produced until the calcium and magnesium in the water have been removed as insoluble soaps—potentially as "bath-tub rings", or depositions in a fabric or other surface. It is further known that while synthetic detergents lather is not adversely affected by water hardness, there is an effect on their performance, especially in the washing of textiles.

The instant formulations which do not contain any builders are designed for conditions of low water hardness, where builders would not provide any enhanced benefit. Builders do not discriminate between the magnesium and calcium ions sourced from the water hardness vs. extra magnesium and calcium moieties added to the formulation to attack grease on dish surfaces. Hence, all magnesium and calcium moieties would be equally sequestered. Accordingly, the elimination of builders creates a more efficacious dishwashing product.

Further, it has been shown that solutions containing phosphate and silicate builders are cloudy in the presence of water hardness. By explicitly excluding any phosphate and/or builders a product with enhanced in-use cosmetic properties can be created.

SUMMARY OF THE INVENTION

This invention relates to a powdered, light duty detergent composition comprising approximately by weight:

(a) from about 15 to about 35% of an anionic and/or nonionic surfactant, preferably about 20 to about 30% of an anionic surfactant such as $C_{10}$–$C_{13}$ linear alkylbenzene sulfonate;

(b) from about 2 to about 15%, preferably about 2 to about 10% of a compound containing magnesium or calcium, such as a magnesium or calcium salt;

(c) from about 1 to about 10%, preferably about 3 to 7% of an alkali metal bicarbonate;

(d) from about 30 to about 80% of a filler, preferably about 50 to 60% of a filler such as sodium sulfate; and (e) the balance being water, wherein, the quantity of bicarbonate is varied to obtain a pH in the wash solution within the range of about 6 to about 10 (approximately a 1% solution of this powder detergent in the wash water), preferably from about 8 to about 10 and the formulation does not contain any builders.

While nonionic as well as anionic surfactants can be utilized, including ether sulfates, amides, APG, alkyl sulfates and ethoxylated alcohols, the preferred formulation contains an anionic linear alkylbenzene sulfonate and more particularly dodecylbenzene sulfonate.

While various materials can be utilized as a filler, including calcium sulfate and sodium chloride, the preferred embodiment as stated above is formulated with sodium sulfate.

The present invention teaches that increased levels of calcium and magnesium salts enhance the grease cutting and removal efficacy of the dishwashing product. The magnesium salts are preferred because they are more soluble in aqueous medium than are calcium salts.

The present invention encompasses a method for cleaning and degreasing dirty dishes which method comprises rinsing the dishes to be cleansed in an aqueous bath containing an effective amount of a composition comprised of the above defined compositions.

DESCRIPTION OF THE INVENTION

Detergent compositions in accordance with the present invention comprise a mixture of anionic and/or non-ionic surfactant, effective levels of magnesium or calcium salt, a filler such as sodium sulfate, an alkali metal bicarbonate or other material to adjust the pH, and water.

As stated above, this invention relates to a powdered, light duty detergent composition comprising approximately by weight:

(a) from about 15 to about 35% of an anionic and/or non-ionic surfactant, preferably about 20 to about 30% of an anionic surfactant, such as $C_{10}$–$C_{13}$ linear alkylbenzene sulfonate;

(b) from about 2 to about 15%, preferably from about 5 to about 10% of a magnesium or calcium salt;

(c) from about 1 to about 10%, preferably from about 3 to about 7% of an alkali metal bicarbonate;

(d) from about 30 to about 80% of a filler, preferably from about 50 to about 60% of a filler such as sodium sulfate; and (e) the balance being water; wherein, the quantity of bicarbonate is varied to obtain a pH in the wash solution within the range of about 6 to about 10 (approximately a 1% solution of this powder detergent in the wash water), preferably from about 8 to about 10 and the formulation does not contain any builders.

A wide variety of anionic surfactants may be utilized. Anionic synthetic detergents can be broadly described as surface active compounds with negatively charged functional group(s). Synthetic anionic surfactants can be represented by the general formula $R_1SO_3M$ wherein $R_1$ represents a hydrocarbon group selected from the group consisting of straight or branched alkyl radicals containing from about 8 to 24 carbon atoms and alkyl phenyl radicals containing from about 9 to about 15 carbon atoms in the alkyl group. M is a salt forming cation which typically is selected from the group consisting of sodium, potassium, ammonium, monoalkanolammonium, dialkanolammonium, trialkanolammonium, and magnesium cations and mixtures thereof. An important class of compounds within this category are the water-soluble salts, particularly the alkali metal salts, of organic sulfur reaction products having in their molecular structure an alkyl radical selected from the group containing from about 8 to 22 carbon atoms and a radical selected from the group consisting of sulfonic acid and sulfuric acid esters radicals.

Particularly suitable anionic surfactants for the instant invention are the higher mononuclear aromatic sulfonates. They contain from 10 to 16 carbon atoms in the alkyl chain. Alkali metal, ammonium or alkanolammonium salts of these sulfonates are suitable, although the sodium salts are preferred. Examples include the higher alkylbenzene sulfonates containing 9 to 18 or preferably 9 to 10 to 15 or 16 carbon atoms in the higher alkyl group in a straight or branched chain, or C8–15 alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example, 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms. These anionic surfactants are preferably present from about 20 to about 30% of weight of the total composition.

Suitable nonionic surfactants which can be used as a total or partial replacement of the anionic surfactant can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements, Nonionic surfactants have the general formula $RA(CH_2CH_2O)_nH$; wherein, R represents the hydrophobic moiety, A represents the group carrying the reactive hydrogen atom and n represents the average number of ethylene oxide moieties. R typically contains from 8 to 22 carbon atoms, but can also be formed by the condensation of propylene oxide with a lower molecular weight compound; and n usually varies from about 2 to about 24. Other so called nonionic surface-actives include alkyl polyglycoside, long chain tertiary amine oxides, long chain tertiary phosphine oxides and dialkyl sulphoxides.

The water soluble nonionic surfactants utilizable in this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good CAN emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri- $C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

Generally, it is felt that calcium and magnesium ions interfere with the washing process by: 1. precipitation of anionic surfactants; 2. causing particulate dirt to flocculate and redeposit on the substrate being cleaned; 3. combining with the free fatty acid in soils, such as sebum, and so interfering with removal of such soils. However, as has been stated above, increased levels of calcium and magnesium ions enhance the grease cutting and removal efficacy of the product, yielding an overall improved cleaning effect in a dishwashing environment. The magnesium salts are preferred because they are more soluble in aqueous medium than are calcium salts and hence with increased concentration exhibit an increased enhanced cleaning effect. The addition of magnesium sulfate, magnesium sulfate heptahydrate, magnesium acetate, magnesium acetate tetrahydrate, magnesium benzoate trihydrate, magnesium chloride, magnesium chloride hexahydrate, magnesium nitrate, or magnesium nitrate hexahydrate and combinations thereof can be used to supply the necessary magnesium ions.

Fillers, such as sodium sulfate, calcium sulfate or sodium chloride can also be added to make the product more economical to produce.

The composition may contain all manner of minor additives commonly found in liquid and powder detergents and in amounts in which such additives are normally employed. Examples of additives include: foam boosters and foam stabilizers, perfumes, enzymes, preservatives, and colorants. The quantity of minor additives may vary from about 0.01% to 5% by weight of the formulation.

The invention is utilized by the addition of an effective quantity of the product into an aqueous bath into which the dirty dishes are introduced. Mechanical action to aid in the removal of the dirt and grease on the dishes can be added by hand action.

The detergent compositions of the invention are preferably presented in free-flowing particulate form, e.g. powdered or granular form, and can be produced by any of the techniques commonly employed in the manufacture of such detergent compositions.

This is generally done via a spray drying process in which an aqueous crutcher slurry is formed containing a mixture of water with many or most of the ingredients desired in the final detergent composition. The solids content of the slurry is generally from about 40% to about 70%, preferably 50% to 65% thereof, the balance being water. The crutcher slurry is then atomized by pumping it through a nozzle at a pressure of about 500 psi into a spray-drying tower, the typical dimensions of a commercial tower being about 35–100 feet in height and about 12–30 feet in diameter. At the base of the tower, air is introduced at a temperature of from about 300°–1000° F. This dry hot air contacts the atomized slurry, providing means for evaporating most of the water contained within the slurry. The resulting dry particles or beads are collected at the bottom of the tower, the moisture and heated air existing at the top. Heat or water-sensitive ingredients such as perfume and nonionic surfactants are conventionally post-added to the tower particles in a subsequent mixing or blending operation.

The crutcher slurry is preferably made by sequentially adding the various components thereof in the manner which will result in the most miscible, readily pumpable and non-setting slurry for spray drying. The order of addition of the various components may be varied, depending on the circumstances. Normally it is preferable for all or almost all of the water to be added to the crutcher first, preferably at about the processing temperature, after which minor components, including any pigments and fluorescent brighteners are added. Finally, the filler salts, such as sodium sulfate, any anionic surfactant, such as sodium dodecyl benzene sulfonate and any magnesium or calcium ion source, such as magnesium sulfate heptahydrate, are added to the crutcher mix. Usually, during such additions, each component will be mixed in thoroughly before addition of the next component but methods of addition may be varied, depending on the circumstances, so as to allow co-additions when such are feasible. Sometimes component additions may be in two or more parts to effect good mixing. Different components may sometimes be pre-mixed before addition to speed the mixing process. Normally, mixing speed and power will be increased as the materials are added. For example, low speeds may be used until after admixing in of the water and minor ingredients, after which the speed may be increased during and after addition of the filler, surfactant and magnesium or calcium ion source to provide a homogeneous slurry mix.

The temperature of the aqueous medium in the crutcher will usually be about room temperature (25° C.) or elevated, normally being in the 20° C. to 70° C. range, and preferably from about 25° C. to 40° C. Heating the crutcher medium may promote solution of the water soluble salts of the mix and thereby increase miscibility, but the heating operation, when effected in the crutcher, can slow production rates. Temperatures higher than 70° C. are usually avoided because of the possibility of decomposition of one or more crutcher mix components, e.g., minor ingredients.

Crutcher mixing times to obtain thoroughly mixed homogeneous slurries can vary widely, from as little as five minutes in small crutchers and for slurries of higher moisture contents, to as much as two hours, in some cases, although 30 minutes is a preferable upper limit.

The uniform crutcher slurry is thereafter transferred in the usual manner to a spray drying tower, which is located near the crutcher. The slurry is normally dropped from the bottom of the crutcher to a positive displacement pump, which forces it at high pressure through spray nozzles with varying sizes of swirl chambers and exit tips, into the spray tower (countercurrent or concurrent), wherein the droplets of the slurry fall through a hot drying gas to form absorptive particles or beads.

After drying, the product is screened to desired size, e.g., 10 to 100 mesh, U.S. Sieve Series, and granular sodium bicarbonate can be proportioned in to the dried beads via a weigh belt. The mixture of dried beads and granular sodium bicarbonate is then ready for application of any perfume and any nonionic surfactant via an overspray in a mixing drum onto the tumbling particles, the particles or beads being either in warm or cooled (to room temperature) condition. Any nonionic surfactant will usually be at an elevated temperature to assure that it will be liquid; yet, upon cooling to room temperature, desirably it will be a solid, often resembling a waxy solid. This characteristic will not adversely affect the flowability of the final composition because the nonionic surfactant normally penetrates to below the bead surface. It is preferred that the spray process used to form the compositions should result in a product having a moisture content of not more than 5%, preferably about 2 to 4%.

Examples of Invention

The invention is further illustrated by the following non-limiting example:

Example 1

| Ingredient | % by weight |
|---|---|
| Part 1 - The slurry which was spray dried was: | |
| Tap Water | 7% |
| Sodium dodecyl benzene sulfonate | 40 |
| Anhydrous sodium sulfate | 42 |
| Magnesium sulfate heptahydrate | 11 |
| Part 2 - Spray Drying Process | |
| Moisture Loss | –28% |
| Approximate Yield | 72% |

A typical spray dried product was produced at 1 ton per hour, in a 14 foot diameter counter-current spray drying unit, at the following conditions:

Slurry: Sprayed at 925 psi

Sprayed through 4/3 nozzles, meaning a #4 size swirl chamber and 3 mm tip

Drying Air: 3,200 cfm

T1 of 575° F.

T2 of 265° F.

| Part 3 - Post Spray Drying Addition of volatile materials and blending was: | |
|---|---|
| Unperfumed base powder | 94.7% |
| Perfume | 0.3 |
| Sodium bicarbonate granular | 5.0 |

The bicarbonate was post added as a dry blend in order to maintain a pH of approximately 8 for a 1% solution. If the bicarbonate was added to the slurry and spray dried, it was converted to carbonate which results in a pH of 10 (for a 1% solution).

The final density was approximately 0.4 gm/ml.

Examples 2, 3 and 4

The following formulas were made according to the procedure detailed in Example 1. (ingredients as a % of total by weight)

| Comparative formulation examples: | 2 | 3 | 4 |
|---|---|---|---|
| Linear alkylbenzene sulfonate | 27 | 27 | 27 |
| Sodium silicate | 0 | 14 | 7 |
| Anhydrous sodium sulfate | 52 | 33 | 12 |
| $MgSO_4.7H_2O$ | 15 | 15 | 15 |
| Water | 6 | 6 | 6 |
| Sodium Tripolyphosphate | 0 | 12 | 12 |
| Sodium Bicarbonate | 0 | 0 | 0 |
| Grease Removal Performance (mg. of lard removed) | 124 | 5 | 71 |

Formula 2, which contains no water softening $SiO_2$ or $Na_2P_2O_7$ ions yielded the maximum grease removal performance as compared to comparative Examples 3 and 4, which contained $SiO_2$ and $Na_2P_2O_7$ ions.

What is claimed is:

1. A particulate detergent composition consisting essentially of (a) from about 15 to about 35% by weight of an anionic/or a nonionic surfactant;

(b) from about 2 to about 15% by weight of a magnesium or calcium salt;

(c) from about 1 to about 7% by weight of an alkali metal bicarbonate;

(d) from about 30 to about 80% of a filler, wherein said filler is selected from the group consisting of calcium sulfate, sodium chloride, and sodium sulfate and mixtures thereof; and (e) the balance being water, the alkali metal wherein the quantity of bicarbonate is varied to obtain a pH in the wash solution within a range of about 6 to about 10 (approximately a 1% solution of this powder detergent in the wash solution), wherein said particulate detergent composition does not contain any builder.

2. The particulate detergent composition of claim 1 wherein the anionic surfactant is a $C_{10}$–$C_{13}$ linear alkylbenzene sulfonate.

3. The particulate detergent composition of claim 1 wherein the source of magnesium salts is selected from the group consisting of magnesium sulfate, magnesium sulfate heptahydrate, magnesium acetate, magnesium acetate tetrahydrate, magnesium benzoate trihydrate, magnesium chloride, magnesium chloride hexahydrate, magnesium nitrate, magnesium nitrate hexahydrate and mixtures thereof.

4. A method for cleaning and degreasing dirty dishes comprising rinsing the dishes to be cleansed in an aqueous bath containing an effective amount of a composition comprised of the composition defined according to claim 1.

* * * * *